US012263998B2

(12) United States Patent
Faerber

(10) Patent No.: US 12,263,998 B2
(45) Date of Patent: Apr. 1, 2025

(54) SEALING MECHANISM FOR A BEVERAGE CONTAINER

(71) Applicant: Runway Blue, LLC, Lehi, UT (US)

(72) Inventor: Paul James Faerber, Orem, UT (US)

(73) Assignee: Runway Blue, LLC, Lehi, UT (US)

( * ) Notice: Subject to any disclaimer, the term of this patent is extended or adjusted under 35 U.S.C. 154(b) by 38 days.

(21) Appl. No.: 18/338,849

(22) Filed: Jun. 21, 2023

(65) Prior Publication Data

US 2023/0415965 A1 Dec. 28, 2023

Related U.S. Application Data

(60) Provisional application No. 63/367,175, filed on Jun. 28, 2022.

(51) Int. Cl.
*B65D 47/32* (2006.01)
*B65D 41/16* (2006.01)

(52) U.S. Cl.
CPC ..... *B65D 47/32* (2013.01); *B65D 41/165* (2013.01)

(58) Field of Classification Search
CPC ..... B65D 47/32; B65D 47/04; B65D 47/06; B65D 51/1644; B65D 41/165; B65D 41/16; B65D 2251/0025; B65D 2205/00
USPC ..... 220/202, 203.01, 203.19, 203.28, 254.3, 220/254.1, 373, 367.1, 709, 705; 215/229, 389, 388; 277/637, 628; 222/566
See application file for complete search history.

(56) References Cited

U.S. PATENT DOCUMENTS 5,971,180 A * 10/1999 Wu ..... B65B 31/046 215/311
2022/0204224 A1* 6/2022 Hiltser ..... B65D 47/043
2024/0023739 A1* 1/2024 Bell ..... B65D 77/28

FOREIGN PATENT DOCUMENTS

CA 2227603 A1 * 2/1997 ..... B65D 47/44
EP 3109181 A1 12/2016
JP 2021050009 A 4/2021

OTHER PUBLICATIONS

International Search Report and Written Opinion for PCT/US2023/068813, mailed on Nov. 27, 2023, 16 pages.

* cited by examiner

*Primary Examiner* — Robert J Hicks
(74) *Attorney, Agent, or Firm* — Sterne, Kessler, Goldstein & Fox P.L.L.C.

(57) ABSTRACT

Some embodiments described herein are directed to a beverage container including a drinking opening, a closure, and a seal. The closure is configured to selectively close the drinking opening. The seal is coupled to the closure and configured to seal the drinking opening when the closure closes the drinking opening. The closure includes a shaft extending down from an interior of the closure. The seal covers the shaft, and a slit extends through a portion of the seal covering the shaft.

24 Claims, 7 Drawing Sheets

SEALING MECHANISM FOR A BEVERAGE CONTAINER

CROSS-REFERENCE TO RELATED APPLICATION

This application claims the benefit of U.S. Provisional Patent Application No. 63/367,175, filed Jun. 28, 2022, which is incorporated herein in its entirety by reference thereto.

FIELD

This disclosure generally relates to beverage containers. More specifically, some embodiments relate to seals and sealing mechanisms for beverage containers.

BACKGROUND

Beverage containers may be sealed relative to an atmosphere outside of the beverage container. A pressure difference may develop between an interior of the beverage container and the atmosphere outside of the beverage container.

SUMMARY

Some embodiments described herein are directed to a beverage container including a drinking opening, a closure, and a seal. The closure is configured to selectively close the drinking opening. The seal is coupled to the closure and configured to seal the drinking opening when the closure closes the drinking opening. The closure includes a shaft extending down from an interior of the closure. The seal covers the shaft, and a slit extends through a portion of the seal covering the shaft.

Some embodiments described herein are directed to a seal for a beverage container including a seal body and a flap coupled to the seal body. A lower surface of the flap is configured to seal a drinking opening of a beverage container. A lower surface of the seal body and an upper surface of the flap define a gap therebetween. The gap is configured to be in fluid communication with an interior volume of the beverage container when the lower surface of the flap seals against the drinking opening of the beverage container.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
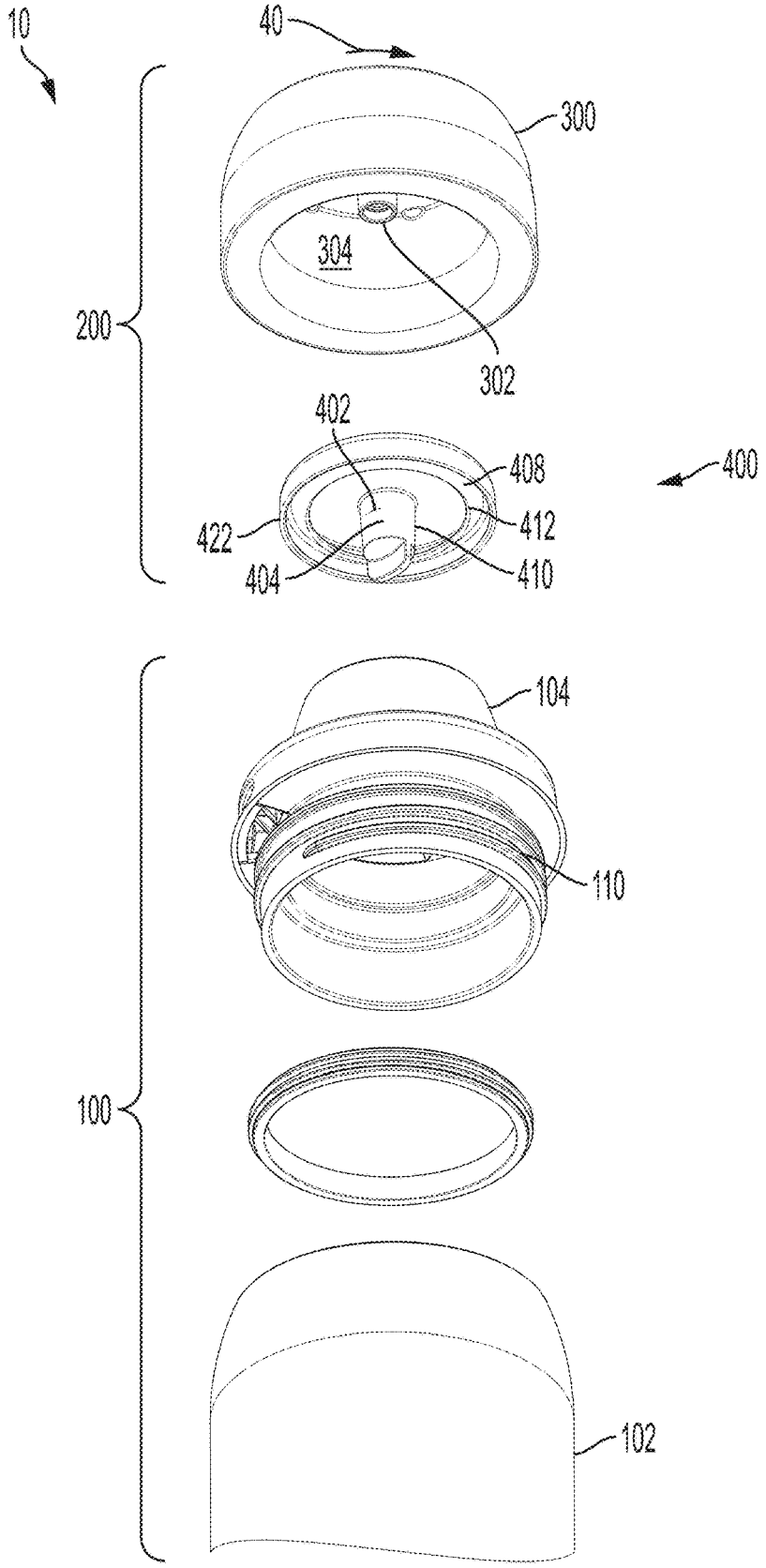
FIG. 1 shows an exploded lower perspective view of a portion of a beverage container.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, and components have not been described in detail to avoid unnecessarily obscuring aspects of the disclosure.

References in the specification to "some embodiments" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable containers to carry a variety of beverages. It is often desirable for a container to be airtight when a user is not drinking from it so that the beverage being carried will not leak on a user or a user's belongings. An airtight container may be achieved by sealing the drinking opening of the container, for example with a closure and a seal. But sometimes, over time, pressure may decrease inside an airtight container (for example when the container is used to carry a cold beverage). When a user later desires to open the container to drink from it, the user may find it difficult to remove the closure of the container due to the pressure difference between the interior of the container and an atmosphere outside the container, which may cause a suction effect between the container and the closure. At other times, pressure may build up inside an airtight container (for example when the container is used to carry a hot beverage). A relatively high pressure inside an airtight container may, for example, cause a seal of the beverage container to be pushed away from the drinking opening and allow a beverage within the container to leak.

It may be desirable to alleviate a low pressure within an airtight container by reducing or eliminating the pressure difference with respect to the atmosphere outside the container, for example, in order to make removal of a closure easier for a user. It may also be desirable for a beverage container to include a seal that remains sealed even under high pressure. "Low pressure" as used here and elsewhere in this disclosure refers to a pressure within a container that is lower than a pressure of the atmosphere outside the container. "High pressure" as used here and elsewhere in this disclosure refers to a pressure within a container that is higher than a pressure of the atmosphere outside the container.

Some embodiments of the present disclosure provide a closure assembly that can alleviate a low pressure within an airtight container. As will be described in more detail below, the exemplifying closure assembly illustrated herein includes a shaft extending from an interior of a closure, a seal that covers the shaft, and a slit that extends through a portion of the seal covering the shaft. When the closure closes a beverage container and a pressure difference between an interior of the beverage container and an atmosphere outside the beverage container falls below a threshold pressure difference, air from the atmosphere passes into the interior of the beverage container through the slit to alleviate the low pressure inside the beverage container.

Some embodiments of the present disclosure provide a beverage container seal that remains sealed under high pressure. As will be described in more detail below, the exemplifying seal illustrated herein includes a seal body, a flap coupled to the seal body, and a gap between a lower surface of the seal body and an upper surface of the flap. When the seal seals an opening of a beverage container and a high pressure exists within the beverage container, air within the beverage container presses the flap against the drinking opening of the beverage container to more strongly seal the drinking opening.

Some embodiments of the present disclosure include a closure assembly that can alleviate a low pressure within an airtight container, as mentioned above and described in more detail below, and a beverage container seal that remains sealed under high pressure, as mentioned above and described in more detail below. But the closure assembly that can alleviate a lower pressure within an airtight container and the beverage container seal that remains sealed under high pressure are independently beneficial, and some embodiments may include one and not the other, in addition to embodiments that include both.

These and other embodiments are discussed below in more detail with reference to the figures.

Figure 2:
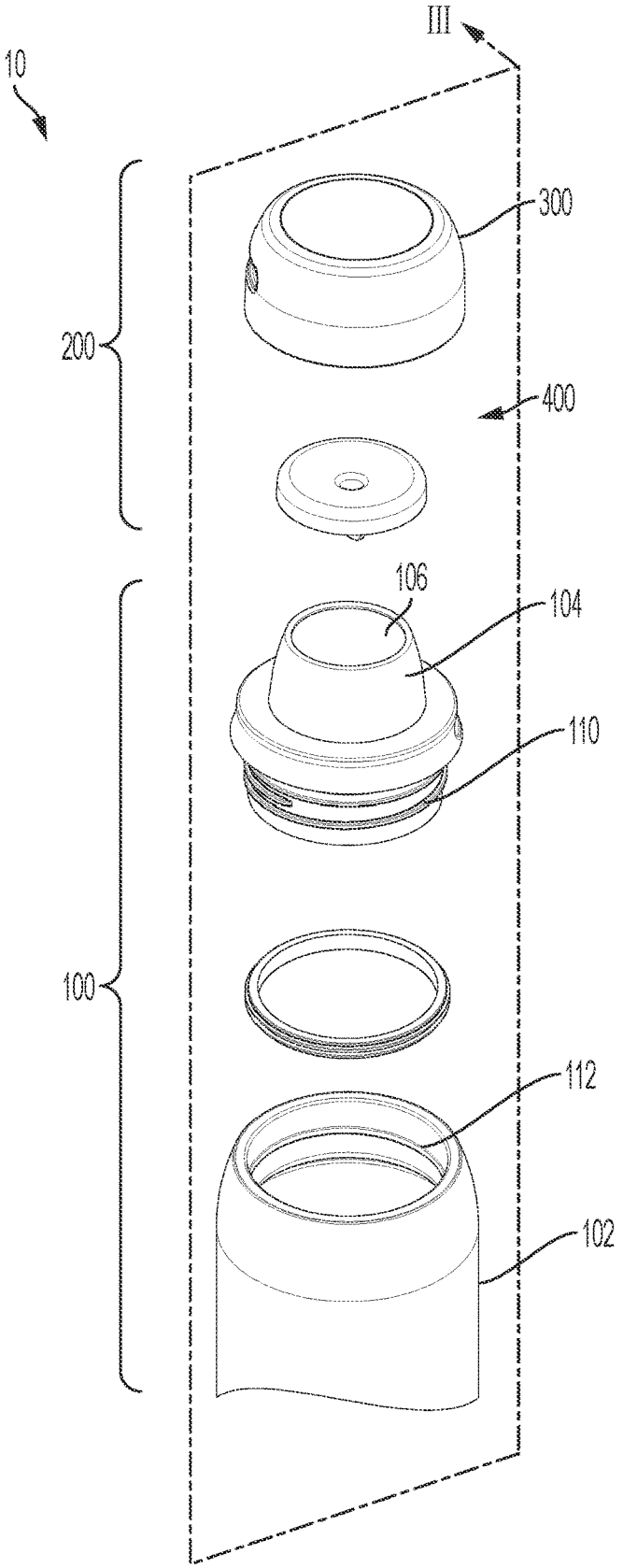
FIG. 2 shows an exploded upper perspective view of a portion of the beverage container of FIG. 1.
Figure 3:
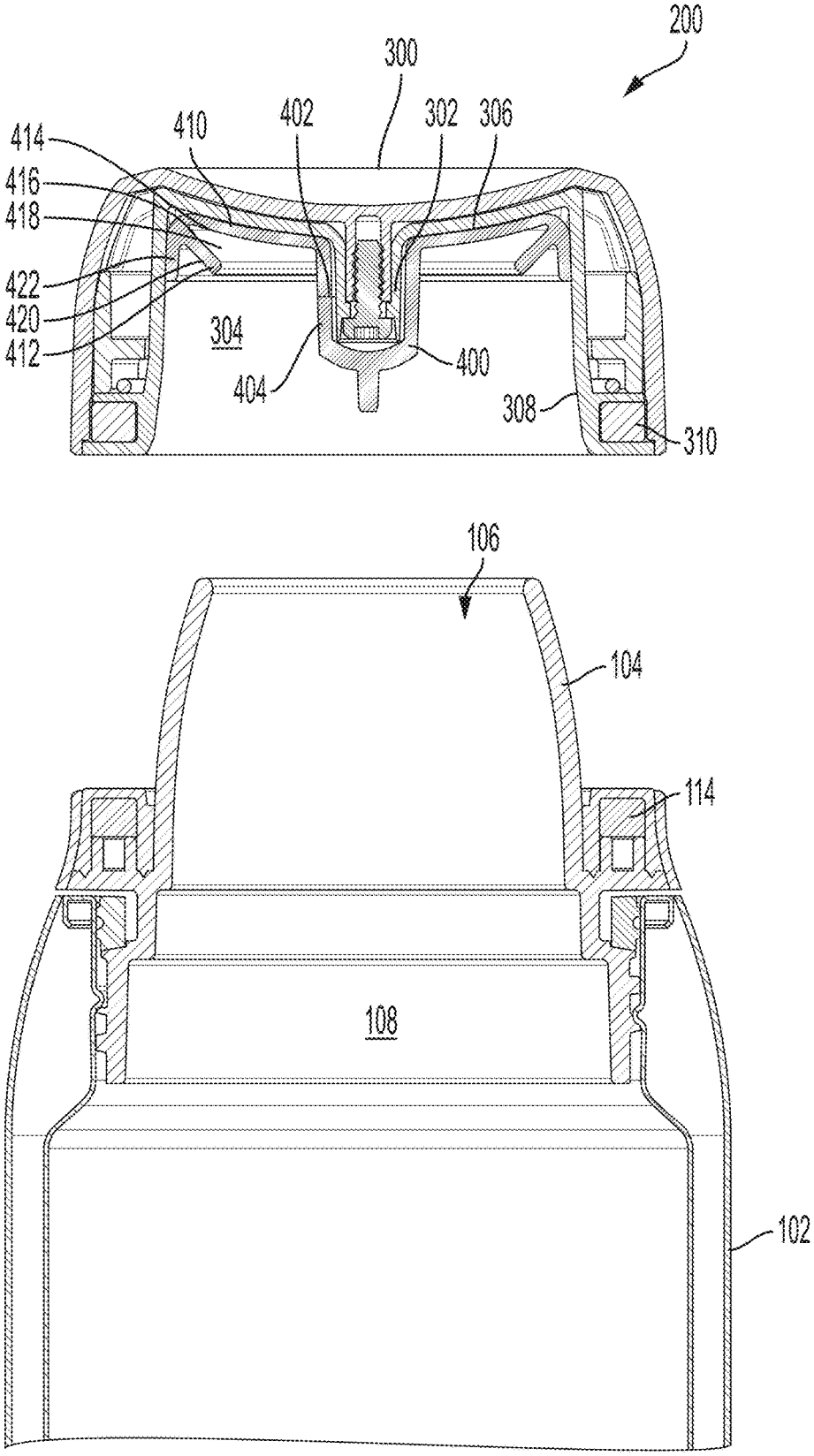
FIG. 3 shows a cross-sectional view of a portion of the beverage container of FIG. 1, with its closure in an open position, taken along plane III of FIG. 2.
Figure 4:
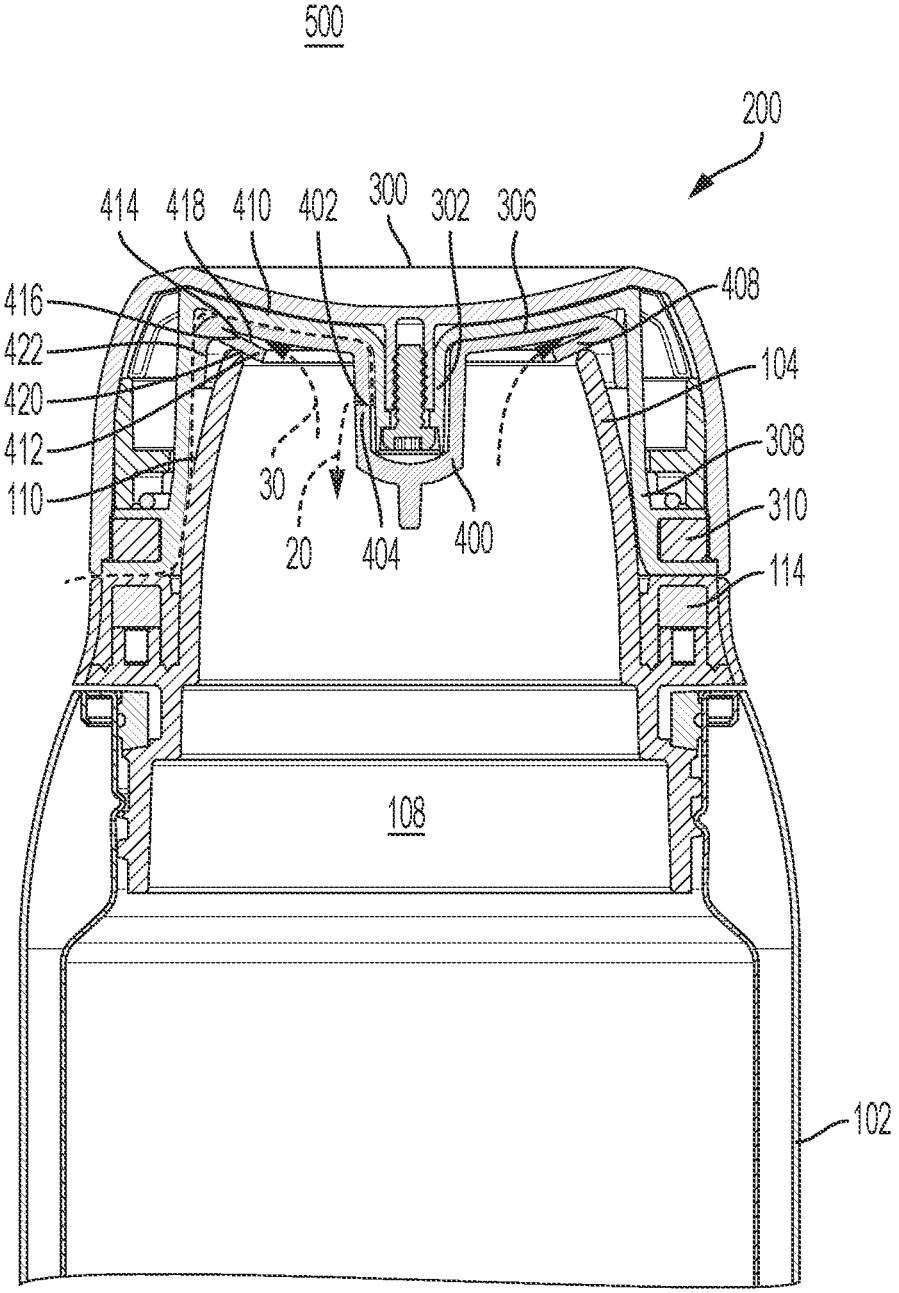
FIG. 4 shows a cross-sectional view of a portion of the beverage container of FIG. 1, with its closure in a closed position, taken along plane III of FIG. 2.

FIGS. 1-2 show exploded views of a drinking vessel 10 according to some embodiments. FIGS. 3-4 are cross-sectional views showing relative positions of certain components of drinking vessel 10.

As shown in FIG. 1, drinking vessel 10 may include a beverage container 100 and a closure assembly 200 that is attachable to beverage container 100.

Beverage container 100 may include a container body 102 and a spout 104. In some embodiments, spout 104 is formed as a separate component from container body 102. In other embodiments, spout 104 may be formed integrally with container body 102.

Beverage container 100 may define a drinking opening 106 (shown, for example, in FIG. 2) through which a user may drink a beverage contained within beverage container 100. In some embodiments, beverage container 100 may define more than one drinking opening 106 through which a user may drink a beverage contained within beverage container 100. In embodiments in which beverage container 100 includes a spout, spout 104 may define drinking opening 106 through which a user may drink a beverage contained within beverage container 100. In some embodiments, a user may drink a beverage contained within beverage container 100 by tilting beverage container 100 and pouring the beverage from beverage container 100 through drinking opening 106 and into the user's mouth. In other embodiments, drinking opening 106 may be in fluid communication with a straw, and a user may drink a beverage within beverage container 100 by sucking the beverage through the straw, through drinking opening 106, and into the user's mouth.

As shown in FIG. 1, closure assembly 200 may include a closure 300 and a seal 400. Closure 300 may selectively close drinking opening 106, and seal 400 may seal drinking opening 106 when closure 300 closes drinking opening 106.

In some embodiments, closure 300 may include a shaft 302 extending down from an interior 304 of closure 300, and seal 400 may include a portion 404 configured to cover shaft 302 when closure 300 and seal 400 are assembled.

In some embodiments, seal 400 may include a slit 402 that extends through seal 400. Slit 402 may be formed by cutting (e.g., slicing) through seal 400. When slit 402 is cut, material may not be removed from seal 400. Accordingly, slit 402 may not form a gap.

In some embodiments, closure 300 may include shaft 302 extending down from interior 304 of closure 300, and slit 402 may extend through portion 404 of seal 400. In some such embodiments, slit 402 may be positioned over shaft 302 when closure 300 and seal 400 are assembled.

In some embodiments, slit 402 extends in a circumferential direction 40 relative to shaft 302. In the embodiment illustrated in FIGS. 1-4, for example, slit 402 extends only in the circumferential direction relative to shaft 302 (i.e., slit 402 does not extend at an angle relative to the circumferential direction). However, in other embodiments slit 402 may extend only partially in a circumferential direction relative to shaft 302. For example, slit 402 may extend at an angle of between 0 and 45 degrees relative to the circumferential direction.

In some embodiments, slit 402 may be approximately 0.5 mm to 4 mm in length. For example, slit 402 may be greater than 0.5 mm in order to be large enough to vent (as opposed to, for example, a pinhole), and less than 4 mm in order to not be so large as to leak, under expected pressures. In some embodiments, slit 402 may be approximately 0.5 mm to 2 mm in length.

FIGS. 3-4 are cross-sectional views showing relative positions of certain components of drinking vessel 10. In FIG. 3, drinking vessel 10 is shown with closure assembly 200 assembled and with closure 300 removed from beverage container 100 (i.e., with closure 300 in an open position). In FIG. 4, drinking vessel 10 is shown with closure assembly 200 assembled and with closure 300 attached to beverage container 100 (i.e., with closure 300 in a closed position).

As shown in FIG. 4, when closure 300 closes drinking opening 106, seal 400 may seal drinking opening 106. With drinking opening 106 sealed, a pressure within interior 108 of beverage container 100 may decrease over time relative to an atmosphere 500 outside beverage container 100 (for example when beverage container 100 is used to carry a cold beverage or when a user moves to a lower altitude with beverage container 100 sealed).

When a difference in pressure between interior 108 of beverage container 100 and atmosphere 500 outside beverage container 100 rises above a threshold pressure difference, air from atmosphere 500 may pass into interior 108 of beverage container 100 through slit 402 (as shown, for example, by arrow 20). This may occur, for example, until the difference in pressure between interior 108 of beverage container 100 and atmosphere 500 outside beverage container 100 is equal to or below the threshold pressure difference.

In some embodiments, air from atmosphere 500 may pass into interior 108 of beverage container 100 by passing into an interior of closure 300, passing between closure 300 and seal 400, and then passing through slit 402.

Figure 7:
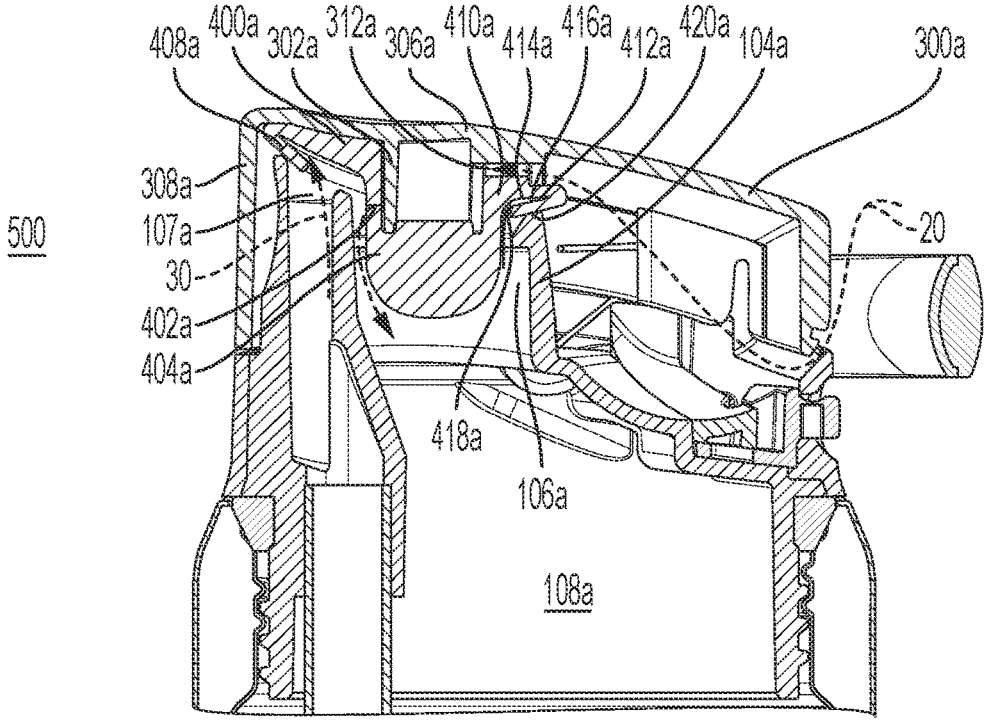
FIG. 7 shows a cross-sectional view of a portion of the beverage container of FIG. 5, with its closure in a closed position, taken along plane VII of FIG. 6.
Figure 8:
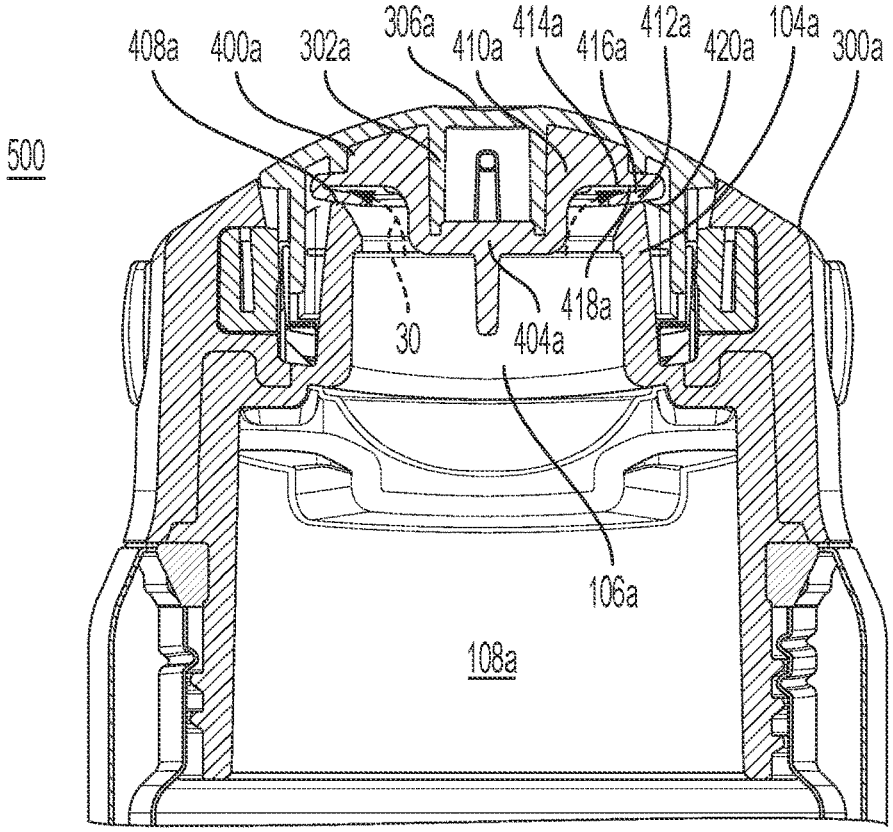
FIG. 8 shows a cross-sectional view of a portion of the beverage container of FIG. 5, with its closure in a closed position, taken along plane VIII of FIG. 6.

In some embodiments, shaft 302 may have a hollow interior and an open end covered by seal 400. In some such embodiments, air from atmosphere 500 may pass into interior 108 of beverage container 100 by passing into an interior of closure 300, passing into the hollow interior of shaft 302, passing through the open end of shaft 302, passing between closure 300 and seal 400, and then passing through slit 402. In the embodiment shown in FIG. 4, the hollow interior and open end of shaft 302 are partially blocked by a screw. However, the partial block may still allow air to pass through the hollow interior and open end. In other embodiments, for example as shown in FIGS. 7 and 8, the hollow interior and open end may be unobstructed.

The configuration of closure assembly 200 may not permit air or liquid to flow in an opposite direction. That is, when closure 300 closes drinking opening 106, air may not be able to pass from interior 108 of beverage container 100 to atmosphere 500 through slit 402 whether the difference in pressure between interior 108 of beverage container 100 and atmosphere 500 outside beverage container 100 is above or below the threshold pressure difference.

Returning to FIG. 1, additional details for implementing some features as have been described will be discussed. The specific structures and mechanisms shown and described (here and anywhere else in this document) may not be the only way to accomplish the functions described, and each element may be implemented using other shapes, structures, and appearances than specifically shown and described.

As mentioned, beverage container 100 may include a container body 102 and a spout 104.

Container body 102 may be any suitable type of container body. Container body 102 may be generally cylindrical in shape (as shown, for example, in FIG. 2) or have another exterior or interior shape. In some embodiments, container body 102 may be double-walled to enhance thermal insulative properties of container body 102. In some embodiments, an area between beverage container body 102's double walls may be hermetically sealed and may form at least a partial vacuum. In some embodiments, container body 102 may be formed of stainless steel. In some embodiments, container body 102 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

As mentioned, spout 104 may be formed as a separate component from container body 102, or may be formed integrally with container body 102. In embodiments in which spout 104 is formed as a separate component from container body 102, spout 104 may be attachable to container body 102. For example, spout 104 may include an attachment mechanism 110 on a lower sidewall of spout 104 and container body 102 may include a corresponding attachment mechanism 112 near an upper edge of container body 102. Attachment mechanism 110 may be configured to engage with attachment mechanism 112 to removably attach spout 104 to container body 102. Attachment mechanisms 110 and 112 may be threaded connectors (as shown in FIG. 2), friction fit connectors, snap-fit connectors, or any other suitable releasable attachment mechanism. The attachment of spout 104 to container body 102 is not limited to the arrangement shown in the figures. For example, in some embodiments, spout 104 may attach over container body 102 rather than inside container body 102.

The type of attachment mechanism used to attach spout 104 to container body 102 may be of the same or a different type than the attachment mechanism used to attach closure assembly 200 to beverage container 100.

Spout 104 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

As mentioned, drinking vessel 10 may include closure assembly 200 to selectively close drinking opening 106. Closure assembly 200 may include a closure 300 and a seal 400.

Closure 300 may be any suitable type of closure. For example, closure 300 may be a cap-type closure that is attachable to beverage container 100 to close drinking opening 106 (as shown, for example, in FIGS. 1-4). As other example, closure 300 may be a flip-type closure that pivots open and closed (as shown, for example in FIGS. 5-8).

As shown in FIGS. 3-4, closure 300 may include a top portion 306 and a side wall 308 defining interior 304. When closure 300 closes drinking opening 106, side wall 308 may at least partially enclose spout 104 such that side wall 308 inhibits dirt or debris from contacting an upper surface of spout 104 which a user is likely to contact when drinking from drinking vessel 10. In some embodiments sidewall 308 may extend around shaft 302. This may, for example, help obscure shaft 302 from a user's view.

In some embodiments, closure 300 may include an attachment mechanism 310 and beverage container 100 may include a corresponding attachment mechanism 114 to removably attach closure 300 to beverage container 100. In some embodiments, for example, the attachment mechanisms may be or include threads (located, for example, on an external surface of spout 104 and on an internal surface of closure 300), friction fit connectors, snap-fit connectors, magnetic connectors, or any other suitable releasable attachment mechanism.

When closure 300 closes drinking opening 106, closure assembly 200 may seal drinking opening 106 but may not completely seal interior 304 of closure 300 from atmosphere 500 outside beverage container 100. For example, closure assembly 200 may leave a region outside spout 104 open to atmosphere 500. This may, for example, allow air from atmosphere 500 to flow into interior 304 of closure 300 between spout 104 and closure sidewall 308 as shown in FIG. 4.

As mentioned, closure 300 may include shaft 302 extending down from an interior 304 of closure 300. In the illustrated embodiment, shaft 302 is integrally formed as part of closure 300. However, in some embodiments, shaft 302 is a separate component from closure 300. In the embodiment illustrated in FIGS. 1-4, shaft 302 extends vertically from top portion 306 of closure 300. However, in other embodiments, shaft 302 may extend at an angle relative to top portion 306 of closure 300.

In the embodiment illustrated in FIGS. 1-4, shaft 302 has a frustoconical shape. This may, for example, allow portion 404 of seal 400 to be more easily positioned over shaft 302. In other embodiments, however, shaft 302 may have another suitable shape (e.g., cylindrical or dome-shaped).

In the embodiment illustrated in FIGS. 1-4, shaft 302 has a circular cross section. This may, for example, allow portion 404 to be positioned over shaft 302 at a variety of orientations. However, the cross sectional shape of shaft 302 is not limited to the shape shown. Shaft 302 may have any suitable cross sectional shape, including, for example, a square, oval, or stadium shape, or may have a cross sectional shape that changes over a length of shaft 302.

Shaft 302 and/or closure 300 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium). Shaft 302 may be formed of the same material or of a different material than other portions of closure 300.

Seal 400 may be coupled to closure 300 and configured such that seal 400 seals drinking opening 106 when closure 300 closes drinking opening 106. Seal 400 may include sealing portion 408 configured to seal drinking opening 106 and portion 404 configured to cover shaft 302 when closure 300 and seal 400 are assembled.

In the embodiment illustrated in FIGS. 1-4, sealing portion 408 contacts an upper surface of spout 104 around drinking opening 106 to seal drinking opening 106 when closure 300 closes drinking opening 106. As shown in FIGS. 3-4, sealing portion 408 resiliently deflects and deforms so that sealing portion 408 is pressed against an upper surface of spout 104, thereby creating a seal between sealing portion 408 and the upper surface of spout 104. In other embodiments, sealing portion 408 may resiliently deform without deflecting, or spout 104 may resiliently deflect, to create a seal between sealing portion 408 and the upper surface of spout 104. In other embodiments, sealing portion 408 may instead extend down into spout 104 and press against an inner surface of spout 104 to create a seal.

In the embodiment illustrated in FIGS. 1-4, sealing portion 404 has an annular shape. However, the shape of sealing portion 404 is not limited to the shape shown in the figures. Rather, sealing portion 404 may have any shape sufficient to seal drinking opening 106 when closure 300 closes drinking opening 106. For example, in the embodiment shown in FIGS. 5-8, spout 104*a* has an upper surface that curves from a rear portion of spout 104*a* up to a front portion of spout 104*a*, and sealing portion 404*a* has a shape that corresponds to the upper surface of spout 104*a* (i.e., a lower surface of sealing portion 404*a* curves from a rear portion of sealing portion 404*a* up to a front portion of sealing portion 404*a*).

As mentioned, seal 400 may include a portion 404 that covers shaft 302 when closure assembly 200 is assembled. Portion 404 may be 0.5 mm to 2 mm thick at slit 402. A thickness within this range may, for example, provide sufficient thickness for slit 402 to remain closed (i.e., sealed) when not needed to allow air to flow into interior 108.

In the embodiment illustrated in FIGS. 1-4, portion 404 has a circular cross section. This may, for example, allow portion 404 to be positioned over shaft 302 at a variety of orientations. However, the cross sectional shape of portion 404 is not limited to the shape shown. Portion 404 may have any suitable cross sectional shape, including, for example, a square, oval, or stadium shape, or may have a cross sectional shape that changes over a length of portion 404.

In the embodiment illustrated in FIGS. 1-4, seal 400 completely covers shaft 302 below slit 402 and completely covers shaft 302 above slit 402. This may, for example, help keep slit 402 closed (i.e., sealed) when not needed to allow air to flow into interior 108 and/or limit openings through which liquid or air within interior 108 of beverage container 100 could leak. In some embodiments, seal 400 completely covers shaft 302 above slit 402 but leaves a bottom portion of shaft 302 at least partially open. In some embodiments, seal 400 completely covers shaft 302 below slit 402 but leaves a top portion of shaft 302 at least partially open.

In some embodiments, slit 402 may be the only opening through seal 400. This may, for example, help prevent liquid or air within interior 108 of beverage container 100 from leaking. In some embodiments, more than one slit 402 may be provided, and slits 402 may be the only openings through seal 400.

In some embodiments, portion 404 may be less rigid than shaft 302. For example, shaft 302 may be formed of polypropylene and portion 404 may be formed of silicone. This difference in rigidity may, for example, allow slit 402 to flex open when needed to allow air to flow into interior 108, while providing sufficient structure to allow slit 402 to remain closed (i.e., sealed) when not needed to allow air to flow into interior 108.

Portion 404 may be configured to fit tightly around shaft 302 when assembled. For example, in some embodiments, an inner surface of portion 404 may be positioned against shaft 302 when closure assembly 200 is assembled and interior 304 of closure 300 is open to atmosphere. As another example, in some embodiments, portion 404 may press inward against shaft 302 when closure assembly 200 is assembled and interior 304 of closure 300 is open to atmosphere (e.g., an interference fit). Having portion 404 fit tightly around shaft 302 when closure assembly 200 is assembled may, for example, help slit 402 remain closed (i.e., sealed) when slit 402 is not needed to allow air from atmosphere 500 into interior 108 of beverage container 100 to alleviate a low pressure.

In some embodiments, when closure assembly 200 is assembled seal 400 may be positioned against an inner surface of closure 300 (e.g., along an inner surface of top portion 306 and/or sidewall 308). In some embodiments, seal 400 may be less rigid than inner surface of closure 300. For example, inner surface of closure 300 may be formed of polypropylene and seal 400 may be formed of silicone. This difference in rigidity may, for example, allow seal 400 to push away from inner surfaces of closure 300 (e.g., due to a low pressure within interior 108 of beverage container 100) in order to allow air to flow from atmosphere 500 between closure 300 and seal 400, as shown in FIG. 4.

Sealing portion 408 of seal 400 may be formed of a food-grade material suitable to seal drinking opening 106. Portion 404 of seal 400 may be formed of a food-grade material suitable for sealing at a slit. Sealing portion 408 and portion 404 may be formed of the same material or may be formed of different materials.

Some of the embodiments discussed above serve to alleviate a low pressure within an airtight container. However, under some circumstances, pressure may instead build up inside drinking vessel 10 (for example when drinking vessel 10 is sealed and used to carry a hot beverage). Some embodiments of the present disclosure provide a beverage container seal that remains sealed under high pressure. These and other embodiments are discussed below in more detail with reference to the figures.

As mentioned, and as shown in FIGS. 1-4, drinking vessel 10 may include a beverage container 100 having a drinking opening 106, and a closure assembly 200 having a seal 400 configured to seal drinking opening 106 when closure assembly 200 closes drinking opening 106.

As can be appreciated from FIG. 3, for example, seal 400 may include a seal body 410 and a flap 412 coupled to seal body 410. In some embodiments, flap 412 may be angled radially inward and downward relative to seal body 410. Accordingly, a lower surface 414 of seal body 410 and an upper surface 416 of flap 412 may define a gap 418 therebetween. In some embodiments, flap 412 and seal body 410 are integrally formed (e.g., molded as a single component).

As mentioned, and as shown in FIG. 4, closure 300 may be configured to close drinking opening 106 (e.g., by attaching to beverage container 100). When closure 300 closes drinking opening 106, a lower surface 420 of flap 412 may contact an upper surface of spout 104 around drinking opening 106 to seal drinking opening 106. As shown in FIG. 4, for example, flap 412 may deflect upward toward seal body 410, and flap 412 and/or spout 104 may resiliently deform so that flap 412 is pressed against an upper surface of spout 104, thereby creating a seal between lower surface 420 of flap 412 and the upper surface of spout 104. Even when flap 412 is deflected upward, however, gap 418 may remain between lower surface 414 of seal body 410 and upper surface 416 of flap 412.

When closure 300 closes drinking opening 106, gap 418 may be in fluid communication with interior 108 of beverage container 100. Thus, air within interior 108 of beverage container 100 may extend into gap 418 and press against flap 412 (as shown by arrow 30 in FIG. 4). Accordingly, when a high pressure exists within interior 108 of beverage container 100 relative to atmosphere 500 outside beverage container 100, the pressure on flap 412 may push flap 412 downward toward an upper surface of spout 104, thereby more strongly sealing lower surface 420 of flap 412 against upper surface of spout 104 surrounding drinking opening 106.

As shown in FIG. 4, in some embodiments, a free end of flap 412 extends radially inward beyond an upper perimeter of drinking opening 106 when closure 300 closes drinking opening 106. This may, for example, help position flap 412 over an upper portion of spout 104 (as opposed to outside spout 104) as closure 300 is being closed.

In some embodiments, seal 400 may include a flange 422. Flange 422 may extend downward along a periphery of seal 400. During use, when closure 300 closes drinking opening 106, flange 422 may extend downward outside spout 104. This may, for example, provide added stability to seal 400 and/or inhibit seal 400 from collapsing into drinking opening 106 when a low pressure develops within interior 108 of beverage container 100.

Figure 5:
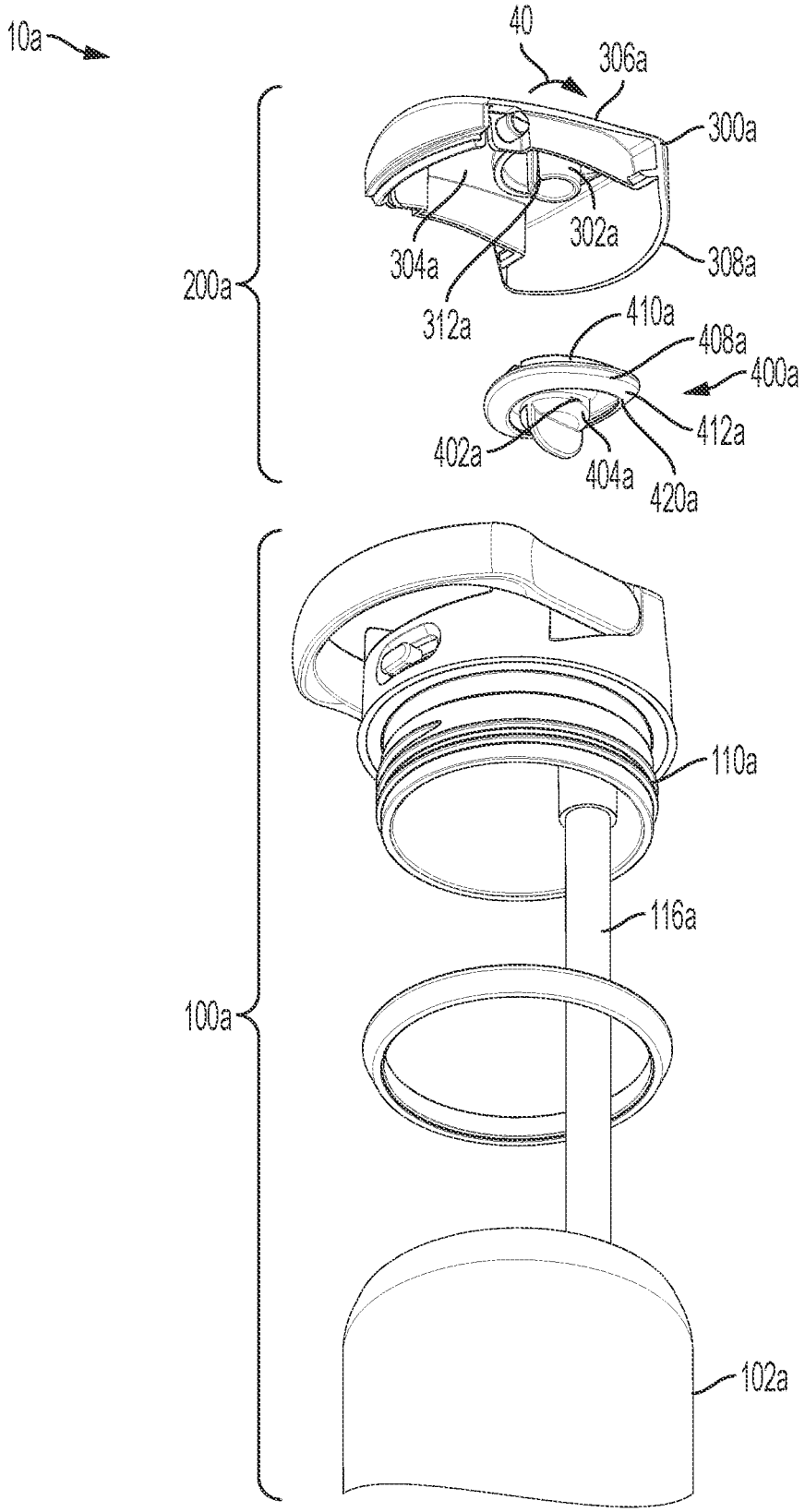
FIG. 5 shows an exploded lower perspective view of a portion of another beverage container.
Figure 6:
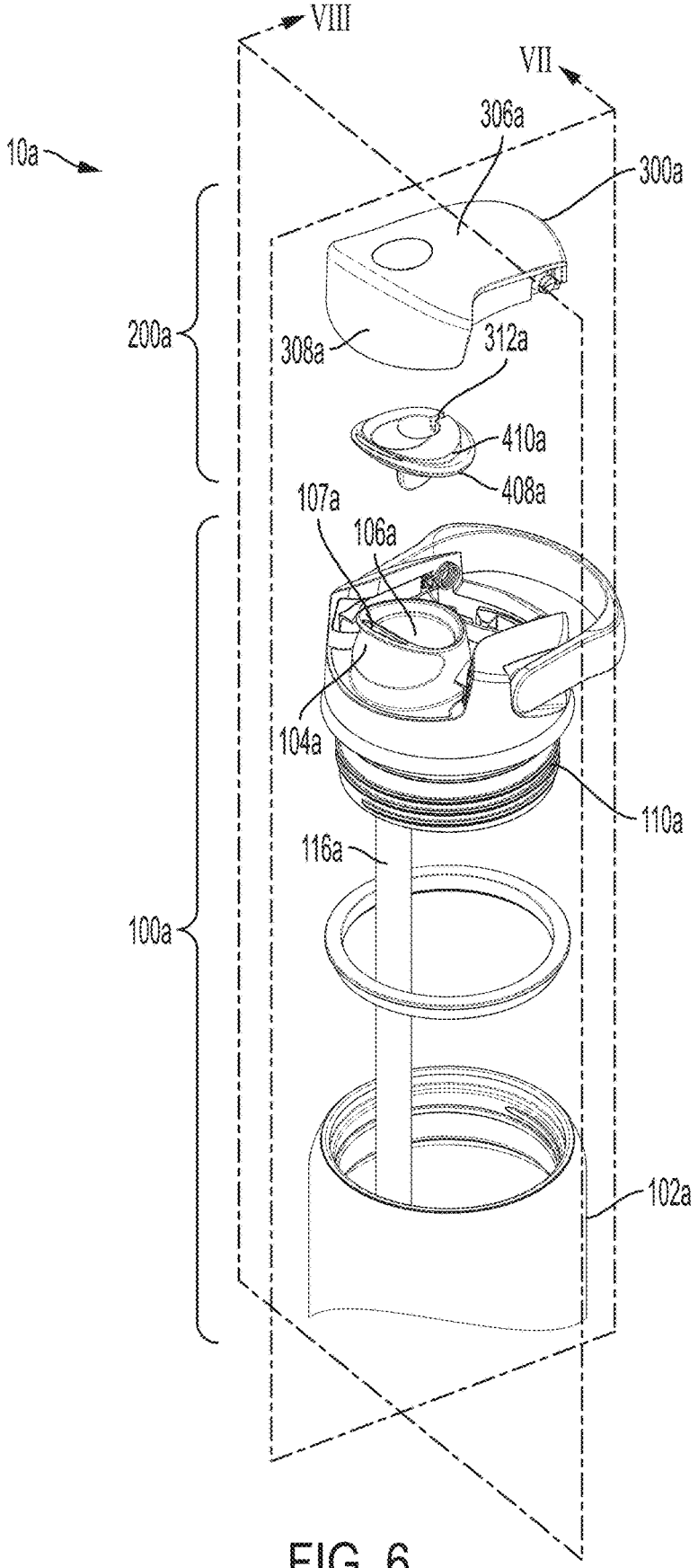
FIG. 6 shows an exploded upper perspective view of a portion of the beverage container of FIG. 5.

FIGS. 5-8 show a drinking vessel 10*a* according to another embodiment. FIGS. 5-6 show exploded views of drinking vessel 10*a* according to some embodiments. FIGS. 7-8 are cross-sectional views showing relative positions of certain components of drinking vessel 10*a*.

Drinking vessel 10*a* may include some or all of the features, structures, or characteristics discussed above with respect to drinking vessel 10. For example, drinking vessel 10*a* may include a beverage container 100*a*, a container body 102*a*, a spout 104*a*, a drinking opening 106*a*, an interior 108*a*, an attachment mechanism 110*a*, a closure assembly 200*a*, a closure 300*a*, a shaft 302*a*, an interior 304*a*, a top portion 306*a*, a side wall 308*a*, a seal 400*a*, a slit 402*a*, a portion 404*a*, a sealing portion 408*a*, a seal body 410*a*, a flap 412*a*, a lower surface 414*a* of seal body 410*a*, an upper surface 416*a* of flap 412*a*, a gap 418*a*, and a lower surface 420*a* of flap 412*a*, which may include some or all of the features, structures, or characteristics discussed above with respect to beverage container 100, container body 102, spout 104, drinking opening 106, interior 108, attachment mechanism 110, closure assembly 200, closure 300, shaft 302, interior 304, top portion 306, side wall 308, seal 400, slit 402, portion 404, sealing portion 408, seal body 410, flap 412, lower surface 414 of seal body 410, upper surface 416 of flap 412, gap 418, and lower surface 420 of flap 412.

In the embodiment shown in FIGS. 5-8, beverage container 100*a* includes a first drinking opening 106*a* and a second drinking opening 107*a* (shown, for example, in FIG. 6) through which a user may drink a beverage stored within beverage container 100*a*. Second drinking opening 107*a* is in fluid communication with a straw 116*a* such that a user may drink a beverage contained within beverage container 100*a* by tilting beverage container 100*a* and pouring the beverage from beverage container 100*a* through drinking opening 106*a* and into the user's mouth or by sucking the beverage through straw 116*a*, through drinking opening 107*a*, and into the user's mouth. In some embodiments, second drinking opening 107*a* may be offset from first drinking opening 106*a* toward a front of spout 104*a*. This may, for example, facilitate a user in drinking comfortably from first drinking opening 106*a* and/or second drinking opening 107*a*.

In the embodiment shown in FIGS. 5-8, closure 300*a* is a flip-top closure that pivots from an open position to a closed position to seal first drinking opening 106*a* and second drinking opening 107*a*. As shown in FIGS. 7-8, when closure 300*a* closes first drinking opening 106*a* and second drinking opening 107*a*, seal 400*a* may seal first drinking opening 106*a* and second drinking opening 107*a*. With first drinking opening 106*a* and second drinking opening 107*a* sealed, a pressure within interior 108*a* of beverage container 100*a* may decrease over time relative to atmosphere 500 outside beverage container 100*a* (for example when beverage container 100*a* is used to carry a cold beverage or when a user moves to a lower altitude with beverage container 100*a* sealed).

When a difference in pressure between interior 108*a* of beverage container 100*a* and atmosphere 500 outside beverage container 100*a* rises above a threshold pressure difference, air from atmosphere 500 may pass into interior 108*a* of beverage container 100*a* through slit 402*a* (as shown by arrow 20*a* in FIGS. 7-8). This may occur, for example, until the difference in pressure between interior 108*a* of beverage container 100*a* and atmosphere 500 outside beverage container 100*a* is equal to or below the threshold pressure difference.

In some embodiments, for example as shown in the embodiment of FIGS. 5-8, closure 300*a* and seal 400*a* may define a channel 312*a*. Channel 312*a* may at least partially define a fluid pathway and may make it easier for air to pass from atmosphere 500 outside beverage container 100*a* into interior 108*a* of beverage container 100*a*. For example, when a difference in pressure between interior 108*a* of beverage container 100*a* and atmosphere 500 outside beverage container 100*a* rises above a threshold pressure difference, air from atmosphere 500 may pass into interior 108*a* of beverage container 100*a* by passing into an interior of closure 300*a*, passing through channel 312*a*, passing between closure 300*a* and seal 400*a*, and then passing through slit 402*a* (as shown by arrow 20*a* in FIGS. 7-8).

As mentioned, in the embodiment shown in FIGS. 5-8, beverage container 100*a* may include first drinking opening 106*a* and second drinking opening 107*a* through which a user can drink a beverage stored within beverage container 100*a*. As shown in FIGS. 7-8, when closure 300*a* closes first drinking opening 106*a* and second drinking opening 107*a*, a lower surface 420*a* of flap 412*a* may contact an upper surface of spout 104*a* around drinking opening 106*a* and/or drinking opening 107*a* to seal drinking opening 106*a* and/or drinking opening 107*a*. As shown in FIGS. 7-8, for example, flap 412*a* may deflect upward toward seal body 410*a*, and flap 412*a* and/or spout 104*a* may resiliently deform so that flap 412*a* is pressed against an upper surface of spout 104*a*, thereby creating a seal between lower surface 420*a* of flap 412*a* and the upper surface of spout 104*a*.

In some embodiments in which beverage container 100*a* includes first drinking opening 106*a* and second drinking opening 107*a*, flap 412*a* of seal 400*a* may seal first drinking opening 106*a* and second drinking opening together (i.e., such that first drinking opening 106*a* is not sealed independently of second drinking opening 107*a*). This may, for example, allow pressure to equalize between interior volume 108*a* of beverage container 100*a* and interior volume of straw 116*a*. This avoids or reduces the likelihood of pressure buildup being relieved through straw 116*a*, which could force liquid out through second drinking opening 107*a* before a user is ready to drink, potentially creating a mess.

As shown in FIGS. 7-8, when closure 300*a* closes first drinking opening 106*a* and second drinking opening 107*a*, gap 418*a* may be in fluid communication with interior 108*a* of beverage container 100*a*. Thus, air within interior 108*a* of beverage container 100*a* may extend into gap 418*a* and press against flap 412*a* (as shown by arrow 30*a* in FIGS. 7-8). Accordingly, when a high pressure exists within interior 108*a* of beverage container 100*a* relative to atmosphere 500 outside beverage container 100*a*, the pressure on flap 412*a* may push flap 412*a* toward an upper surface of spout 104*a*, thereby more strongly sealing lower surface 420*a* of flap 412*a* against drinking opening 106*a*.

As shown in FIGS. 7-8, sealing portion 408*a* may have a different shape than sealing portion 408 shown in FIGS. 1-4. In the embodiment shown in FIGS. 1-4, sealing portion 408 lies generally in a horizontal plane. However, in the embodiment shown in FIGS. 5-8, spout 104*a* has an upper surface that curves from a rear portion of spout 104*a* up to a front portion of spout 104*a*, and sealing portion 404*a* has a shape that corresponds (i.e., a lower surface of sealing portion 404*a* curves from a rear portion of sealing portion 404*a* up to a front portion of sealing portion 404*a*).

As shown in FIGS. 7-8, seal 400*a* does not include a flange at an outer periphery (as in the embodiment illustrated in FIGS. 1-4). As mentioned above, a flange is not necessary to achieve some functions as have been described.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. A beverage container comprising:

a drinking opening;

a closure configured to selectively close the drinking opening, and a seal coupled to the closure and configured to seal the drinking opening when the closure closes the drinking opening, wherein the closure comprises a shaft extending down from an interior of the closure, wherein the seal covers the shaft, and wherein a slit extends through a portion of the seal covering the shaft.

2. The beverage container of claim 1, wherein the slit extends in a circumferential direction relative to the shaft.

3. The beverage container of claim 1, wherein the seal completely covers the shaft below the slit.

4. The beverage container of claim 1, wherein the seal completely covers the shaft above the slit.

5. The beverage container of claim 1, wherein the slit is the only opening through the seal.

6. The beverage container of claim 1, wherein the shaft is more rigid that the portion of the seal covering the shaft.

7. The beverage container of claim 1, wherein, when the interior of the closure is open to atmosphere, the seal presses inward against the shaft.

8. The beverage container of claim 1, wherein, when the closure closes the drinking opening and a difference in pressure between an interior of the beverage container and an atmosphere outside the beverage container rises above a threshold pressure difference, air from the atmosphere passes into the interior of the beverage container through the slit.

9. The beverage container of claim 1, wherein, when the closure closes the drinking opening and a difference in pressure between an interior of the beverage container and an atmosphere outside the beverage container rises above a threshold pressure difference, air from the atmosphere passes into the interior of the beverage container through the slit until the difference in pressure is equal to or below the threshold pressure difference.

10. The beverage container of claim 1, wherein, when the closure closes the drinking opening, air does not pass from the interior of the beverage container to an atmosphere outside the beverage container through the slit whether the difference in pressure between the interior of the beverage container and the atmosphere outside the beverage container is above or below the threshold pressure difference.

11. The beverage container of claim 1, wherein when the closure closes the drinking opening and a difference in pressure between an interior of the beverage container and an atmosphere outside the beverage container rises above a threshold pressure difference, air from the atmosphere passes into the interior of the beverage container by passing through a hollow interior of the shaft, through an open end of the shaft, and through the slit.

12. The beverage container of claim 1, wherein the shaft has a frustoconical shape.

13. The beverage container of claim 1, wherein the slit is formed by cutting.

14. The beverage container of claim 1, wherein the slit does not form a gap.

15. The beverage container of claim 1, wherein the portion of the seal covering the shaft at the slit is 0.5 mm to 2 mm thick.

16. The beverage container of claim 1, wherein the slit is less than 4 mm in length.

17. A seal for a beverage container, the seal comprising:
a seal body; and
a flap coupled to the seal body,
wherein a lower surface of the flap is configured to seal a drinking opening of a beverage container,
wherein a lower surface of the seal body and an upper surface of the flap define a gap therebetween, and
wherein the gap is configured to be in fluid communication with an interior volume of the beverage container when the lower surface of the flap seals against the drinking opening of the beverage container.

18. The seal of claim 17, wherein the flap and seal body are integrally formed.

19. The seal of claim 17, wherein the flap is angled radially inward and downward relative to the seal body.

20. A beverage container comprising:
a drinking opening;
a closure configured to selectively close the drinking opening; and
the seal of claim 17,
wherein the seal is configured to seal the drinking opening when the closure closes the drinking opening.

21. The beverage container of claim 20, wherein a free end of the flap extends radially inward beyond an upper perimeter of the drinking opening when the closure closes the drinking opening.

22. The beverage container of claim 20, wherein when the closure closes the drinking opening:
the flap deflects upward, and
a gap remains between a lower surface of the seal body and an upper surface of the flap.

23. A beverage container comprising:
a spout defining a drinking opening;
a closure configured to selectively close the drinking opening; and
the seal of claim 17,
wherein the seal is configured to seal the drinking opening when the closure closes the drinking opening,
wherein the seal comprises a flange coupled to the seal body, and
wherein, when the closure closes the drinking opening, the flange extends downward outside the spout.

24. A beverage container comprising:
a drinking opening;
a closure configured to selectively close the drinking opening, the closure comprising a shaft extending down from an interior of the closure; and
a seal coupled to the closure, the seal comprising:
a seal body;
a portion coupled to the seal body and covering the shaft;
a slit extending through the portion of the seal covering the shaft; and
a flap coupled to the seal body,
wherein a lower surface of the flap is configured to seal the drinking opening of the beverage container when the closure closes the drinking opening,
wherein a lower surface of the seal body and an upper surface of the flap define a gap therebetween, and
wherein the gap is configured to be in fluid communication with an interior volume of the beverage container when the lower surface of the flap seals against the drinking opening of the beverage container.

* * * * *